United States Patent [19]

Hale et al.

[11] Patent Number: 4,931,154

[45] Date of Patent: Jun. 5, 1990

[54] PRODUCTION OF METAL BOROHYDRIDES AND ORGANIC ONIUM BOROHYDRIDES

[75] Inventors: Cecil H. Hale; Hossein Sharifian, both of Austin, Tex.

[73] Assignee: Southwestern Analytical Chemicals, Inc., Austin, Tex.

[21] Appl. No.: 380,997

[22] Filed: Jul. 17, 1989

[51] Int. Cl.[5] ..... C25B 1/00; C25B 3/04

[52] U.S. Cl. ..... 204/59 R; 204/72; 204/86

[58] Field of Search ..... 204/59 R, 72, 73 R, 204/86

[56] References Cited

U.S. PATENT DOCUMENTS

| | | | |
|---|---|---|---|
| 2,855,353 | 10/1958 | Huff et al. | 204/59 R |
| 2,938,923 | 5/1960 | Schechter et al. | 204/59 R |
| 3,734,842 | 5/1973 | Cooper | 204/86 |

OTHER PUBLICATIONS

Merck Index of Chemical and Drugs, 7th edition, p. 64, Merck and Co., Rahway, N.J., 1960.

*Primary Examiner*—John F. Niebling
*Assistant Examiner*—Steven P. Marquis
*Attorney, Agent, or Firm*—Renner, Otto, Boisselle & Sklar

[57] ABSTRACT

A process is described for preparing metal borohydrides and onion borohydrides in an electrolysis cell which comprises an anolyte compartment containing an anode and a catholyte compartment containing a cathode, the anolyte and catholyte compartments being separated from each other by a cation exchange membrane which is effective at a pH below 7, said process comprising (A) charging an anolyte comprising an aqueous solution of at least one acid to the anolyte compartment;

(B) charging a catholyte comprising an aqueous solutiuon prepared from a metal boron oxide or an organic onium boron oxide to the catholyte compartment;

(C) passing a current through the electrolysis cell to produce the metal borohydride or an organic inium borohydride in the catholyte compartment; and (D) removing at least a portion of the catholyte from the catholyte compartment.

In one preferred embodiment, quaternary ammonium borohydrides are prepared utilizing quaternary ammonium boron oxides in the aqueous catholyte and inorganic acids such as sulfuric acid in the anolyte solution.

47 Claims, 1 Drawing Sheet

PRODUCTION OF METAL BOROHYDRIDES AND ORGANIC ONIUM BOROHYDRIDES

TECHNICAL FIELD

This invention relates to an electrolytic process for preparing metal borohydrides and onium borohydrides from the corresponding boron oxides.

BACKGROUND OF THE INVENTION

U.S. Pat. No. 3,734,842 describes an electrolytic process for the production of alkali metal borohydrides wherein borate ions are reduced to borohydride ions. In particular, the process utilizes an electrolytic cell having a cationic-selective membrane separating the anode and cathode compartments, and the reduction of borate ions to borohydride ions occurs in the cathode compartment to produce alkali metal borohydride solution from which the borohydride material may be separated. The borate ions utilized in the catholyte solution of the process are derived from alkali metal metaborate, alkali metal tetraborate, borax, and boric acid. The anolyte solution utilized in the anolyte compartment comprises an aqueous solution of an alkali metal hydroxide, alkali metal chloride, alkali metal sulfate or alkali metal carbonate.

SUMMARY OF THE INVENTION

A process is described for preparing metal borohydrides and onium borohydrides in an electrolysis cell which comprises an anolyte compartment containing an anode and a catholyte compartment containing a cathode, the anolyte and catholyte compartments being separated from each other by a divider, said process comprising (A) charging an anolyte comprising an aqueous solution of at least one acid to the anolyte compartment;

(B) charging a catholyte comprising an aqueous solution prepared from a metal boron oxide or an organic onium boron oxide to the catholyte compartment;

(C) passing a current through the electrolysis cell to produce the metal borohydride or an organic onium borohydride in the catholyte compartment; and (D) removing at least a portion of the catholyte from the catholyte compartment.

The metal borohydrides and onium borohydrides can be recovered from the catholyte removed in step (D).

In one preferred embodiment, quaternary ammonium borohydrides are prepared utilizing quaternary ammonium boron oxides in the aqueous catholyte and inorganic acids such as sulfuric acid in the anolyte solution.

DESCRIPTION OF THE PREFERRED EMBODIMENTS

Figure 1:
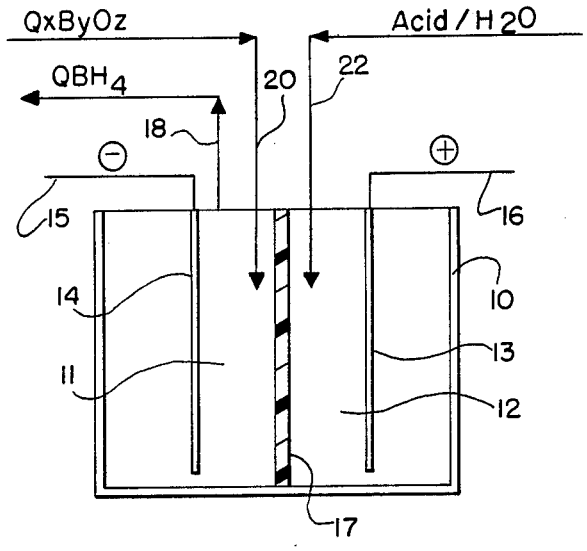
FIG. 1 is a schematic cross-section of an electrolytic cell useful in performing the process for preparing the borohydrides of the invention.

A variety of borohydride compounds can be prepared in accordance with the process of the present invention, and these include metal borohydrides and organic onium borohydrides including quaternary ammonium borohydrides, quaternary phosphonium borohydrides, etc. The metal borohydrides include the alkali metal borohydrides, the alkaline earth metal borohydrides, and the borohydrides of other metals such as aluminum. The process is particularly useful for preparing alkali metal borohydrides, and more particularly sodium borohydride.

Organic onium borohydride compounds also can be prepared by the process of the present invention, and specific examples of types of onium borohydrides include quaternary ammonium borohydrides, and quaternary phosphonium borohydrides such as represented by the following formulae $$[(R_1R_2R_3R_4)N]^+BH_4^- \text{ or} \quad \text{(IIIA)}$$

$$[(R_1R_2R_3R_4)P]^+BH_4^- \quad \text{(IIIB)}$$

wherein $R_1$, $R_2$, $R_3$ and $R_4$ are each independently alkyl groups containing from 1 to about 10 carbon atoms, hydroxyalkyl groups or alkoxyalkyl groups containing from about 2 to about 10 carbon atoms, aryl groups, or $R_1$ and $R_2$, together with the N or P atom may form a heterocyclic group provided that if the heterocyclic group contains a —C=N— or —C=P— bond, $R_3$ is the second bond.

In one preferred embodiment, $R_1$, $R_2$, $R_3$ and $R_4$ are each independently alkyl groups containing from 1 to about 10 carbon atoms and more generally from about 1 to about 4 carbon atoms. Specific examples of alkyl groups include methyl, ethyl, n-propyl, n-butyl, n-pentyl, n-hexyl, n-heptyl, n-octyl, n-nonyl and n-decyl groups. Preferred examples of alkyl groups include methyl, ethyl and butyl groups. $R_1$, $R_2$, $R_3$ and $R_4$ also may be hydroxyalkyl groups such as hydroxyethyl and the various isomers of hydroxypropyl, hydroxybutyl, hydroxypentyl, etc. Specific examples of alkoxyalkyl groups include methoxymethyl, ethoxymethyl, ethoxyethyl, butoxyethyl, butoxybutyl, etc. The aryl groups may be substituted aryl groups as well as unsubstituted aryl groups, and the substituent may be any substituent which does not interfere with the process of the present invention. Examples of various aryl useful as $R_1$, $R_2$, $R_3$ and $R_4$ include phenyl, benzyl, and equivalent groups wherein benzene rings have been substituted with one or more hydroxy groups.

Any two of groups $R_1$ through $R_4$ may comprise alkylene groups joined together with the N or P atom to form a heterocyclic group containing 2 to 5 carbon atoms provided that if the heterocyclic group contains a —C=N— or a —C=P— bond, a third R group is the second bond. Examples of such heterocyclic groups include aziridines and phosphiranes (2 carbon atoms), azetidines and phosphetanes (3 carbon atoms) pyrrolidines and phospholanes (4 carbon atoms), piperidines and phosphanes (5 carbon atoms).

Specific examples of quaternary ammonium borohydrides represented by Formulae IIIA, which can be prepared in accordance with the process of the present invention include tetramethylammonium borohydride, tetraethylammonium borohydride, tetrapropylammonium borohydride, tetrabutylammonium borohydride, trimethylhydroxyethylammonium borohydride, dimethyldi(hydroxyethyl)ammonium borohydride, methyltri(hydroxyethyl)ammonium borohydride, phenyltrimethylammonium borohydride, phenyltriethylammonium borohydride, benzyltrimethylammonium borohydride, N,N-dimethyl-pyrrolidinium borohydride, N,N-di-ethyl-pyrrolidinium borohydride, N,N-dimethyl-piperidinium borohydride, N,N-diethyl-piperidinium borohydride, etc.

Examples of quaternary phosphonium borohydrides as represented by Formula IIIB which may be prepared in accordance with the process of the present invention include tetramethylphosphonium borohydride, tetramethylphosphonium borohydride, tetrapropylphosphonium borohydride, tetrabutylphosphonium borohydride, trimethylhydroxyethylphosphonium borohydride, dimethyldi(hydroxyethyl)phosphonium borohydride, methyltri(hydroxyethyl)phosphonium borohydride, methyltriphenyl phosphonium borohydride, phenyltrimethylphosphonium borohydride, phenyltriethylphosphonium borohydride, benzyltrimethylphosphonium borohydride.

The above-described borohydrides are prepared in accordance for the process of the present invention from the corresponding metal boron oxides or organic onium boron oxides. The boron oxides include borates, metaborates, tetraborates, perborates, or the hydrates, and anhydrides thereof. Mixtures of the various boron oxides also may be utilized such as, for example, sodium borate and sodium perborate. The particular form of boron oxide present in the catholyte solution at any particular time is not critical, and the solution may comprise mixtures of the various forms of boron oxide as the electrolytic reaction proceeds.

The above-described organic onium borohydrides represented by Formulae IIIA and IIIB are prepared by the electrolysis and reduction of the corresponding ammonium or phosphonium boron oxide compounds which may generically be represented by the formula $$Q_xB_yO_z \quad \text{(II)}$$

wherein Q represents a quaternary ammonium ion or a quaternary phosphonium ion; B is boron; O is oxygen; x is 1 or 2; y is 1 or 4; and z is 2, 3 or 7. When x and y are 1 and z is 2 ($QBO_2$), the compound is a metaborate; when x is 2, Y is 4 and z is 7 ($Q_2B_4O_7$), the compound is a tetraborate; and when x is 1, y is 1 and z is 3 ($QBO_3$), the compound is a perborate.

Accordingly, the quaternary ammonium boron oxide compounds useful as starting materials present in the catholyte may be any one or more of the following generic types.

$$[(R_1R_2R_3R_4)N]^+BO_2^- \quad \text{(IIA)}$$

$$[(R_1R_2R_3R_4)N]^+BO_3^- \quad \text{(IIB)}$$

$$[(R_1R_2R_3R_4)N]^+{}_2B_4O_7^= \quad \text{(IIC)}$$

wherein $R_1$, $R_2$, $R_3$ and $R_4$ are as defined with respect to Formula IIIA. The catholyte solutions may be prepared from one or more of the above-described types of boron oxides or available hydrates thereof. Formulae similar to the above can also be written to represent the phosphonium boron oxides utilized as reactants in the process of the present invention. In one preferred embodiment, the boron oxide compounds can be prepared by reacting a quaternary ammonium or phosphonium salt with boric acid or boric acid anhydride. The salts may be hydroxides, halides, carbonates, alkyl carbonates, formates, phosphates, sulfates, etc. The type of boron oxide compound (II) which results is not critical and may in fact be a mixture of boron oxides such as a mixture of metaborate and perborate.

Specific examples of quaternary ammonium boron oxides as represented generically by Formula II, more particularly by Formulae IIA-C, include tetramethylammonium metaborate, tetramethylammonium tetraborate, tetramethylammonium perborate, tetraethylammonium metaborate, tetramethylammonium tetraborate, tetramethylammonium perborate, tetrabutylammonium metaborate, tetrabutylammonium tetraborate, tetrabutylammonium perborate, trimethylhydroxyethylammonium metaborate, dimethyldi(hydroxyethyl)ammonium metaborate, phenyltrimethylammonium metaborate, phenyltriethylammonium metaborate, benzyltrimethylammonium metaborate, N,N-dimethyl-pyrrolidinium metaborate, etc.

Examples of quaternary phosphonium boron oxides which can be utilized in preparing the catholyte solutions used in the process of the present invention include tetramethylphosphonium metaborate, tetramethylphosphonium metaborate, tetrapropylphosphonium metaborate, tetrabutylphosphonium metaborate, tetrabutylphosphonium perborate, trimethylhydroxyethylphosphonium metaborate, dimethyldi-(hydroxyethyl)phosphonium metaborate, methyltriphenylphosphonium metaborate, phenyltriethylphosphonium metaborate, etc.

The above-described metal and organic boron oxides are utilized in the process of the present invention as a component in the catholyte solution which is charged to the catholyte compartment. The amount of the boron oxide compound used to form the catholyte may vary over a wide range and may even be a major amount. Generally, however, from about 1 to about 40% by weight of the boron oxide compound is used to form the aqueous catholyte solution.

The anolyte utilized in the electrolytic process of the present invention comprises an aqueous acid solution. The aqueous acid solutions generally are prepared with acids characterized as having, in aqueous solution at about 25° C., a dissociation constant of greater than about $4\times10^{-4}$ for the first hydrogen. Generally, such acids will comprise inorganic acids such as sulfuric acid, hydrochloric acid, nitric acid, phosphoric acid, and mixtures thereof. The aqueous anolyte generally will contain from about 2% to about 30% by weight of the acid. In one embodiment, the anolyte may be from about a 0.1 Molar to about 6 Molar acid solution.

In the process of the present invention, (A) an anolyte comprising an aqueous solution comprising at least one acid as defined above is charged to the anolyte compartment;

(B) a catholyte comprising an aqueous solution containing a metal boron oxide or an organic onium boron oxide is charged to the catholyte compartment;

(C) a current is passed through the electrolysis cell to produce the metal borohydride or the organic onium borohydride in the catholyte compartment; and (D) at least a portion of the catholyte is removed from the catholyte compartment.

The phrase "aqueous solution" above is defined herein to include aqueous solutions in which the aqueous component may include deuterium oxide ($D_2O$, also known as "heavy water"), tritium oxide ($T_2O$), or a mixture of $D_2O$ and $T_2O$. The afore-mentioned process conducted using $D_2O$ and/or $T_2O$ produces borohydrides which contain a roughly equivalent amount of deuterium and/or tritium anions as the hydride component of the borohydride produced in step (C). The aqueous component of the aqueous solution may be pure, or substantially pure, $D_2O$ and/or $T_2O$, or may be present in ordinary water in an amount greater than their natural abundance. Depending on the intended percentage of deuterium and/or tritium anions in the borohydride, $D_2O$ may, for example, be present in an amount from as low as about 0.02 mole percent to 99.9 mole percent $D_2O$ relative to the amount of ordinary $H_2O$ present in order to be considered enriched with $D_2O$. The amount of $T_2O$ present may be adjusted relative to deuterium and/or hydrogen so that the borohydride product produced therefrom produces a detectable amount of radiation from the decay of the tritium anion. The aqueous component may, for example, contain an amount of $T_2O$ above natural abundance up to about 10 mole percent or more.

The borohydride-containing catholyte obtained in step (D) from the catholyte compartment may be used without separation of the borohydride in some applications. For example, the solution can be used in the reductive bleaching of paper pulp and for reducing various organic compounds. The solution also can be used in the operation of a fuel cell using the borohydride as the fuel source. Where the borohydride is needed in a more concentrated form, the withdrawn catholyte solution can be concentrated, or the borohydride can be isolated from the solution such as by crystallization, evaporation, etc.

In addition to the utilities set forth above, when the hydride component of the borohydride-containing catholyte obtained in step (D) is obtained from a $D_2O$ and/or $T_2O$ enriched aqueous solution, the borohydride-containing catholyte is useful as an agent for transferring deuterium or tritium to another agent or compound which is capable of accepting the deuterium or tritium from the borohydride during reduction. The deuterium and/or tritium labeled borohydride may, for example, be used to transfer deuterium or tritium to an organic compound, such as a pharmaceutical, for detection or tracing purposes. Tritium, for example, is commonly used as a label for tracing the metabolic passways of organic compounds in biological systems due to the ability to detect the small amount of low level radioactivity generated by the decay of tritium into lighter forms of hydrogen. Deuterium is often used, for example, in the detection or tracing of organic compounds in humans, since it is undesirable to expose humans to radio-labeled compounds. Deuterium-labeled compounds may be detected using mass spectrometry.

The presence of deuterium in certain pharmaceuticals is also capable of slowing down metabolization of that pharmaceutical to achieve a longer lasting effect, and the presence of deuterium sometimes decreases a pharmaceutical's toxicity by changing the pharmaceutical's metabolic pathway.

Various materials which have been used as anodes in electrolysis cells can be included in the cells used in the above and other embodiments of the present invention provided they do not react with the solution added to the cells. For example, the anode may be made of high purity graphite or metals such as, for example, titanium-coated or clad electrodes, tantalum, zirconium, hafnium or alloys of the same. Generally, the anodes will have a non-passivable and catalytic film which may comprise metallic noble metals such as platinum, iridium, rhodium or alloys thereof, or a mixture of electroconductive oxides comprising at least one oxide or mixed oxides of a noble metal such as platinum, iridium, ruthenium, palladium or rhodium.

Various materials which have been used as cathodes in electrolytic cells can be included in the cells used in the above and other embodiments of the present invention. Cathode materials include nickel, iron, stainless steel, nickel plated titanium, platinum, etc. The term "alloy" is used in a broad sense and includes intimate mixtures of two or more metals as well as one metal coated onto another metal. The above-described anode and cathode materials may be coated or dispersed on a metal or inert substrate to form the desired anode or cathode.

During the electrolysis, it is desirable that the temperature within the liquid of the cell be maintained in the range of from about 10° C. to about 70° C., and more generally, the temperature is maintained at about 50° C. or below during electrolysis.

Electrolysis is effected by impressing a current voltage (generally a direct current) between the anode and the cathode with a current density of from about 5 to about 250 $A/ft^2$, and more preferably at a current density of from about 25 to about 150 $A/ft^2$. Alternatively, the current density may be from about 1–100 $A/dm^2$ or 10–50 $A/dm^2$. The current density is applied to the cell for a period of time which is sufficient to result in the desired reaction and production of the borohydride. In practice, the electrolytic cell can be operated batchwise or in a continuous operation.

The process of the present invention is conducted in an electrolytic cell which comprises an anolyte compartment containing an anode and a catholyte compartment containing a cathode, the anolyte and catholyte compartments being separated from each other by a diffusion barrier or divider.

The divider in the electrolytic cells used in this invention may be any material which functions as a gas separator. Examples of such divider materials include inert fabrics, sintered glass, ceramics, and membrane diaphragms. Membrane diaphragms are particularly useful and are preferred. The membrane dividers are preferably cation-exchange membranes.

The cationic membranes utilized in electrolytic cells and in the process of the present invention comprise a highly durable material such as the membrane based on the fluorocarbon series, or from less expensive materials of the polystyrene or polypropylene series. Preferably, however, the cationic membranes useful in the present invention include fluorinated membranes containing cation-exchange groups such as perfluorosulfonic acids and perfluorosulfonic acid/perfluorocarboxylic acid, perfluorocarbon polymer membranes such as those sold by the E. I. DuPont Nemours and Company under the trade designation "Nafion". Other suitable cation-exchange membranes include styrene-divinyl benzene copolymer membranes containing cation-exchange groups such as sulfonate groups, carboxylate groups, etc.

The type of electrolysis cell used in the process of the present invention is not critical and may be any of the known electrolysis cells. The cells may be composed of conventional cell materials which are compatible with the materials being charged into the compartments.

The application of the current through the cell results in the reduction of the boron oxide compound contained in the catholyte to the corresponding borohydride. At the anode, water in the aqueous acidic solution is ionized, and the hydrogen ions migrate through the divider (membrane) into the catholyte solution. In the catholyte, the boron oxide is converted to the borohydride. The borohydride is retained in the catholyte by the divider and can be recovered by withdrawing a portion of the catholyte after the electrolysis has progressed. The borohydride can then be recovered from the removed solution by crystallization or precipitation followed by filtration, centrifugation, etc.; by extraction (i.e., partitioning between distinct liquid phases); etc.

The reactions which occur during electrolysis are illustrated as follows utilizing the metaborate form of the boron oxide. Other similar reactions can be written for other forms of boron oxide. At the cathode:

$$BO_2^- + 4H_2 = BH_4^- + 2H_2O \quad (1)$$

$$2H_2O + 2e^- = 2OH^- + H_2 \quad (2)$$

$$2OH^- + 2H^+ = 2H_2O \quad (3)$$

At the anode:

$$H_O = 2H^+ + 1/2O_2 + 2e^- \quad (4)$$

Overall reaction:

$$Q^+BO_2^- + 2H_2O + 8e^- = Q^+BH_4^- + 2O_2 \quad (5)$$

A schematic cross-section or representation of an electrolytic cell useful in the process of the present invention is shown in FIG. 1. In FIG. 1, the electrolytic cell 10 comprises a catholyte compartment 11 and an anolyte compartment 12 separated from each other by a divider 17 such as a cationic selective membrane. The catholyte compartment 11 contains cathode 14 which is attached to a power supply (not illustrated) by wire 15. The anolyte compartment 12 contains anode 13 which is attached to a power supply (not illustrated) through wire 16. With reference to FIG. 1, the anolyte comprising an aqueous acid solution is supplied to the anolyte compartment as illustrated by line 22, and the catholyte comprising an aqueous solution of $Q_xB_yO_z$ is supplied to the catholyte compartment as shown by line 20. After passage of a direct current through the electrolysis cell whereby the desired borohydride is formed in the catholyte, at least a portion of the catholyte containing the borohydride ($QBH_4$) and some unreacted boron oxide is withdrawn as shown by line 18 and the borohydride can be recovered from the catholyte.

The process of the present invention and the results obtained from the process can be enhanced by adding a hydrogenation catalyst to the cathode compartment. The hydrogenation catalyst generally is added to the cathode compartment as a powder, flake, pellets or granules which are maintained within the cathode compartment by means of the divider. The hydrogenation catalyst may be distributed throughout the cathode compartment or the hydrogenation catalyst may be maintained in contact with the cathode (sometimes referred to as a fixed bed cathode). The hydrogenation catalyst used in the process of the present invention may be any of the many hydrogenation catalysts known in the art. Preferred examples include nickel, cobalt, iron, copper, platinum, palladium, rhodium, or alloys, compounds or mixtures thereof. The hydrogenation catalyst incorporated into the cathode compartment may be the same as or different from the cathode material.

The following examples illustrate the process of the present invention utilizing a catholyte prepared with a quaternary ammonium boron oxide (tetramethylammonium borate) and aqueous sulfuric acid anolyte. Similar processes can be conducted utilizing catholytes prepared with other boron oxides and other inorganic acids in the anolyte.

Unless otherwise indicated in the following examples, and elsewhere in the specification and claims, all parts and percentages are by weight, all temperatures are in degrees Celsius, and pressure is at or near atmospheric pressure.

EXAMPLE 1

An electrolytic cell is prepared in accordance with the present invention wherein the anode is platinum clad with a surface area of 40 $cm^2$, and the cathode is a nickel sheet with a surface area of 40 $cm^2$. A solution (100 ml) of aqueous 2.0 M sulfuric acid is charged to the anolyte compartment, and a 25% solution (100 ml.) of tetramethylammonium borate is charged to the catholyte compartment. The anolyte and catholyte compartments are separated by means of a cationic membrane (Nafion 427). The electrolysis is carried out at 50 $mA/cm^2$ for a period of two hours. A current efficiency of 25% is achieved for the synthesis of tetramethylammonium borohydride.

EXAMPLE 2

The procedure of Example 1 is repeated except a solution of 10% sodium metaborate in aqueous 1.0 M sodium hydroxide is used as the catholyte. The electrolysis is carried out the current density of 50 $mA/cm^2$ for a period of two hours. A current efficiency of 20% is achieved for the synthesis of sodium borohydride.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for preparing metal borohydrides and organic onium borohydrides in an electrolysis cell which comprises an anolyte compartment containing an anode and a catholyte compartment containing a cathode, the anolyte and catholyte compartments being separated from each other by a divider, said process comprising (A) charging an anolyte comprising an aqueous solution of at least one acid to the anolyte compartment;

(B) charging a catholyte comprising an aqueous solution prepared from a metal boron oxide or an organic onium boron oxide to the catholyte compartment;

(C) passing a current through the electrolysis cell to produce the metal borohydride or an organic onium borohydride in the catholyte compartment; and (D) removing at least a portion of the catholyte from the catholyte compartment.

2. The process of claim 1 wherein the metal boron oxide is an alkali metal boron oxide.

3. The process of claim 1 wherein the organic onium boron oxide is a quaternary ammonium boron oxide or a quaternary phosphonium boron oxide.

4. The process of claim 1 wherein the dissociation constant of the acid charged in step (A) in aqueous solution at about 25° C. is greater than about $4\times10^4$ for the first hydrogen.

5. The process of claim 1 wherein the acid in the solution charged in step (A) is an inorganic acid selected from the group of $H_2SO_4$, HCl, $HNO_3$, $H_3PO_4$ and mixtures thereof.

6. The process of claim 1 wherein the boron oxide used to prepare the aqueous catholyte solution charged in step (B) is a metaborate, tetraborate, perborate, borate or the hydrates, anhydrides or mixtures thereof.

7. The process of claim 1 wherein at least one hydrogenation catalyst is present in the catholyte compartment.

8. The process of claim 7 wherein the hydrogenation catalyst is nickel, cobalt, rhodium, iron, copper, platinum, palladium or alloys, compounds or mixtures thereof.

9. The process of claim 1 wherein the divider is a cation exchange membrane.

10. The process of claim 9 wherein the cation exchange membrane comprises a perfluorosulfonic acid or a perfluorosulfonic acid/perfluorocarboxylic acid perfluorocarbon polymer membrane.

11. The process of claim wherein (E) the metal or organic onium borohydride is recovered from the catholyte solution removed in step (D).

12. The process of claim 1 wherein the organic onium boron oxide contains an onium group characterized by the formulae $$(R_1R_2R_3R_4)N^+ \text{ or} \quad \text{(IA)}$$

$$(R_1R_2R_3R_4)P^+ \quad \text{(IB)}$$

wherein $R_1$, $R_2$, $R_3$ and $R_4$ are each independently alkyl groups containing from 1 to about 10 carbon atoms, hydroxyalkyl or alkoxyalkyl groups containing from about 2 to about 10 carbon atoms, aryl groups, or $R_1$ and $R_2$, together with the N or P atom may form a heterocyclic group provided that if the heterocyclic group contains a —C=N— bond or a —C=P— bond, $R_3$ is the second bond.

13. The process of claim 12 wherein $R_1$, $R_2$, $R_3$ and $R_4$ are each independently alkyl groups containing from 1 to 4 carbon atoms.

14. The process of claim 11 wherein $R_1$, $R_2$, $R_3$ and $R_4$ are methyl groups.

15. The process of claim 1 wherein the organic onium boron oxide is prepared by the reaction of an organic onium salt with boric acid or boric acid anhydride.

16. The process of claim 1 wherein a direct current is passed through the electrolysis cell in step (C).

17. The process of claim 1 wherein the catholyte charged in step (B) is prepared with from about 1 to about 40% by weight of the boron oxide compound.

18. The process of claim 1 wherein the concentration of the acid in the anolyte charged in step (A) is from about 0.1 to about 6 Molar.

19. The process of claim 1 wherein the metal boron oxide in (B) is a sodium boron oxide.

20. The process of claim 1 wherein the anolyte charged in step (A) and the catholyte charged in step (B) together comprise at least about 0.02 mole percent deuterium oxide.

21. The process of claim 1 wherein the anolyte charged in step (A) and the catholyte charged in step (B) together comprise at least about 10 mole percent deuterium oxide.

22. The process of claim 1 wherein the anolyte charged in step (A) and the catholyte charged in step (B) together comprise an amount of tritium oxide which is greater than that which is naturally occurring.

23. The process of claim 1 wherein the anolyte charged in step (A) and the catholyte charged in step (B) together comprise at least about 0.1 mole percent tritium oxide.

24. A process for preparing metal borohydrides or organic onium borohydrides in an electrolysis cell which comprises an anolyte compartment containing an anode and a catholyte compartment containing a cathode, the anolyte and catholyte compartments being separated from each other by a cation exchange membrane, said process comprising (A) charging to the anolyte compartment an anolyte comprising an aqueous solution containing at least one acid having a dissociation constant in water at about 25° C. of greater than about $4\times10^{-4}$ for the first hydrogen;

(B) charging a catholyte comprising an aqueous solution prepared from a metal boron oxide or an organic onium boron oxide to the catholyte compartment;

(C) passing a current through the electrolysis cell to produce the metal borohydride or an organic onium borohydride in the catholyte compartment; and (D) removing at least a portion of the catholyte from the catholyte compartment.

25. The process of claim 24 wherein the acid in the solution charged in step (A) is an inorganic acid selected from the group of $H_2SO_4$, HCl, $HNO_3$, $H_3PO_4$, and mixtures thereof.

26. The process of claim 24 wherein the acid charged in step (A) is $H_2SO_4$.

27. The process of claim 24 wherein the metal boron oxide is an alkali metal boron oxide.

28. The process of claim 22 wherein the organic onium boron oxide is a quaternary ammonium boron oxide or quaternary phosphonium boron oxide.

29. The process of claim 24 wherein the metal or organic onium boron oxide used to make the catholyte solution charged in step (B) is a borate, metaborate, tetraborate or perborate, or the hydrates, anhydrides, or mixtures thereof.

30. The process of claim 24 wherein at least one hydrogenation catalyst is present in the catholyte compartment.

31. The process of claim 30 wherein the hydrogenation catalyst is nickel, cobalt, rhodium, iron, copper, platinum, palladium or alloys, compounds or mixtures thereof.

32. The process of claim 24 wherein (E) the metal borohydride or the organic onium borohydride is recovered from the catholyte solution removed in step (D).

33. The process of claim 24 wherein the catholyte comprises at least one quaternary ammonium boron oxide and the quaternary ammonium group is characterized by the formula $$(R_1R_2R_3R_4)N^+ \quad \text{(IA)}$$

wherein $R_1$, $R_2$, $R_3$ and $R_4$ are each independently alkyl groups containing from 1 to about 10 carbon atoms, hydroxyalkyl or alkoxyalkyl groups containing from about 2 to about 10 carbon atoms, aryl groups, or $R_1$ and $R_2$, together with the N may form a heterocyclic group, provided that, if the heterocyclic group contains a —C=N— group, $R_3$ is the second bond.

34. The process of claim 33 wherein $R_1$, $R_2$, $R_3$ and $R_4$ are each independently alkyl groups containing from 1 to 4 carbon atoms.

35. The process of claim 33 wherein $R_1$, $R_2$, $R_3$ and $R_4$ are methyl groups.

36. The process of claim 24 wherein a direct current is passed through the electrolysis step in step (C).

37. The process of claim 24 wherein the cation exchange membrane comprises a perfluorosulfonic acid or a perfluorosulfonic acid/perfluorocarboxylic acid perfluorocarbon polymer membrane.

38. The process of claim 24 wherein the catholyte is an aqueous solution prepared with a quaternary ammonium boron oxide prepared by reacting a quaternary ammonium salt with boric acid or boric acid anhydride.

39. A process for preparing a quaternary ammonium borohydride in an electrolysis cell which comprises an anolyte compartment containing an anode and a catholyte compartment containing a cathode, the anolyte and catholyte compartments being separated from each other by a cation exchange membrane, said process comprising (A) charging to the anolyte compartment, an anolyte comprising an aqueous solution containing at least one acid having a dissociation constant in water at about 25° C. of greater than about $4\times10^{-4}$ for the first hydrogen;

(B) charging to the catholyte compartment, an aqueous solution prepared with from about 1 to about 40% by weight of at least one quaternary ammonium boron oxide, said quaternary ammonium boron oxide being obtained by reacting boric acid or boric acid anhydride with a quaternary ammonium hydroxide of the formula $$(R_1R_2R_3R_4)N^+OH^- \quad \text{(IC)}$$

(C) passing a direct current through the electrolysis cell to produce the quaternary ammonium borohydride represented by the formula $$[(R_1R_2R_3R_4)N]^+BH_4^- \quad \text{(IIIA)}$$

in the catholyte wherein $R_1$, $R_2$, $R_3$ and $R_4$ in Formulae IC and IIIA are each independently alkyl groups containing from 1 to about 10 carbon atoms, or hydroxyalkyl groups containing from 2 to about 10 carbon atoms;

(D) removing at least a portion of the catholyte containing quaternary ammonium borohydride from the catholyte compartment.

40. The process of claim 39 wherein $R_1$, $R_2$, $R_3$ and $R_4$ are each independently alkyl groups containing from 1 to 4 carbon atoms.

41. The process of claim 39 wherein $R_1$, $R_2$, $R_3$ and $R_4$ are methyl groups.

42. The process of claim 39 wherein the quaternary ammonium boron oxide used to prepare the solution charged to the catholyte compartment in step (B) is a borate, metaborate, tetraborate, perborate, or the hydrates or mixtures thereof.

43. The process of claim 39 wherein the cation exchange membrane comprises a perfluorosulfonic acid or a perfluorosulfonic acid/perfluorocarboxylic acid perfluororhydrocarbon polymer membrane.

44. The process of claim 39 wherein quaternary ammonium borohydride is recovered from the catholyte by extraction or by crystallization or precipitation followed by filtration or centrifugation.

45. The process of claim 39 wherein at least one hydrogenation catalyst is present in the catholyte compartment.

46. The process of claim 45 wherein the hydrogenation catalyst is nickel, rhodium, copper, platinum, palladium or alloys, compounds or mixtures thereof.

47. The process of claim 39 wherein (E) the quaternary ammonium borohydride is recovered from the catholyte solution removed in step (D).

* * * * *